US011401139B2

(12) United States Patent
Sahs

(10) Patent No.: US 11,401,139 B2
(45) Date of Patent: Aug. 2, 2022

(54) ADJUSTABLE SCREW JACK

(71) Applicant: Austin Sahs, Fort Worth, TX (US)

(72) Inventor: Austin Sahs, Fort Worth, TX (US)

( * ) Notice: Subject to any disclaimer, the term of this patent is extended or adjusted under 35 U.S.C. 154(b) by 0 days.

(21) Appl. No.: 16/903,010

(22) Filed: Jun. 16, 2020

(65) Prior Publication Data

US 2020/0399101 A1 Dec. 24, 2020

(51) Int. Cl.
*B66F 3/08* (2006.01)

(52) U.S. Cl.
CPC ..... *B66F 3/08* (2013.01)

(58) Field of Classification Search
CPC ..... B66F 1/00; B66F 1/06; B66F 3/00; B66F 3/28; B66F 3/08
USPC ..... 254/100, 103, 133 R
See application file for complete search history.

(56) References Cited

U.S. PATENT DOCUMENTS

| | | | | |
|---|---|---|---|---|
| 251,698 | A * | 1/1882 | Coats | B66F 3/08 254/100 |
| 390,605 | A | 10/1888 | Joyce | |
| 1,532,702 | A | 11/1924 | George | |
| 1,842,959 | A | 4/1929 | Clark | |
| 1,951,660 | A * | 3/1934 | Klaudt | A47H 1/022 211/123 |
| 2,093,284 | A * | 9/1937 | Mandl | E21D 15/54 72/54 |
| 7,685,689 | B1 * | 3/2010 | Del Castello | E03C 1/2665 29/281.1 |
| 2007/0181864 | A1 | 8/2007 | Bartee | |

* cited by examiner

*Primary Examiner* — Orlando E Aviles
*Assistant Examiner* — Jacob Adam Montgomery
(74) *Attorney, Agent, or Firm* — Leavitt Eldredge Law Firm

(57) ABSTRACT

A screw jack system comprising of a first end plate, a second end plate, a bolt, a first nut, and a second nut. The first nut is coupled to the first end plate and allows for fine length adjustments. The second nut is coupled to the second end plate. The second nut includes an elongated barrel which receives the thread of the bolt. One or more rubber pads are secured to the first end plate and the second end plate to add length, surface tension, or a combination thereof.

3 Claims, 2 Drawing Sheets

ADJUSTABLE SCREW JACK

BACKGROUND

1. Field of the Invention

The present invention relates generally to screw jack systems, and more specifically to a screw jack system capable of easily adjusting its length to lift, rest, separate, hold, or space objects.

2. Description of Related Art

Screw jack systems are well known in the art and are effective means to handle heavy loads. For example, screw jack systems are often used to lift automobiles, support the foundations of houses, and aid in other construction projects. One of the problems commonly associated with this is that conventional screw jack systems are difficult to adjust the length. There is a need for a screw jack system that is capable of finely adjusting its length.

Accordingly, although great strides have been made in the area of screw jack systems, many shortcomings remain.

DESCRIPTION OF THE DRAWINGS

The novel features believed characteristic of the embodiments of the present application are set forth in the appended claims. However, the embodiments themselves, as well as a preferred mode of use, and further objectives and advantages thereof, will best be understood by reference to the following detailed description when read in conjunction with the accompanying drawings, wherein:

Figure 1:
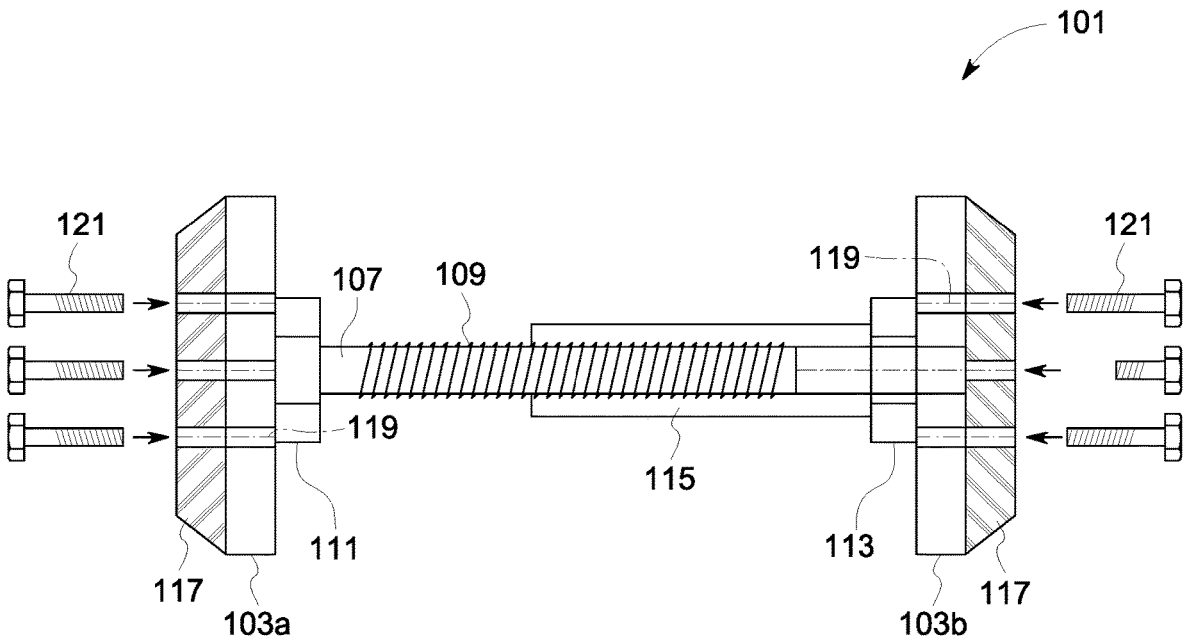
FIG. 1 is side profile view of a preferred embodiment of the screw jack system of the present application.

While the system and method of use of the present application is susceptible to various modifications and alternative forms, specific embodiments thereof have been shown by way of example in the drawings and are herein described in detail. It should be understood, however, that the description herein of specific embodiments is not intended to limit the invention to the particular embodiment disclosed, but on the contrary, the intention is to cover all modifications, equivalents, and alternatives falling within the spirit and scope of the present application as defined by the appended claims.

DETAILED DESCRIPTION OF THE PREFERRED EMBODIMENT

Illustrative embodiments of the system and method of use of the present application are provided below. It will of course be appreciated that in the development of any actual embodiment, numerous implementation-specific decisions will be made to achieve the developer's specific goals, such as compliance with system-related and business-related constraints, which will vary from one implementation to another. Moreover, it will be appreciated that such a development effort might be complex and time-consuming, but would nevertheless be a routine undertaking for those of ordinary skill in the art having the benefit of this disclosure.

The system and method of use in accordance with the present application overcomes one or more of the above-discussed problems commonly associated with conventional screw jack systems. Specifically, the present invention provides a system that allows for fine adjustments of the length of the bolt. These and other unique features of the system and method of use are discussed below and illustrated in the accompanying drawings.

The system and method of use will be understood, both as to its structure and operation, from the accompanying drawings, taken in conjunction with the accompanying description. Several embodiments of the system are presented herein. It should be understood that various components, parts, and features of the different embodiments may be combined together and/or interchanged with one another, all of which are within the scope of the present application, even though not all variations and particular embodiments are shown in the drawings. It should also be understood that the mixing and matching of features, elements, and/or functions between various embodiments is expressly contemplated herein so that one of ordinary skill in the art would appreciate from this disclosure that the features, elements, and/or functions of one embodiment may be incorporated into another embodiment as appropriate, unless described otherwise.

The preferred embodiment herein described is not intended to be exhaustive or to limit the invention to the precise form disclosed. It is chosen and described to explain the principles of the invention and its application and practical use to enable others skilled in the art to follow its teachings.

Referring now to the drawings wherein like reference characters identify corresponding or similar elements throughout the several views, FIG. 1 depicts a side profile view of a screw jack system in accordance with a preferred embodiment of the present application. It will be appreciated that system 101 overcomes one or more of the above-listed problems commonly associated with conventional screw jack systems.

In the contemplated embodiment, system 101 comprises of a first end plate 103*a*, a second end plate 103*b*, a bolt 107 incorporating a thread 109, a first nut 111, and a second nut 113. The first end plate 103*a* and the second end plate 103*b* have a plurality of openings 119 in which a plurality of screws 121 may be inserted therein. The first nut 111 is affixed to the first end plate 103*a*.

The second nut includes an elongated barrel 115 in which incorporates a second thread (not shown) therein to receive the thread 109 of bolt 107. The second nut is affixed to the second end plate 103*b*.

System 101 also includes one or more rubber grips 117 (or rubber pads) can be secured to the first end plate 103*a* and/or the second end plate 103*b* via the plurality of screws 121. The one or more rubber pads 117 allow a user to increase the length of system 101, provide surface tension, or a combination thereof.

It is contemplated and will be appreciated that system 101 can incorporate a plurality of lengths and sizes.

It is also contemplated and will be appreciated that the first end plate 103*a* and the second end plate 103*b* comprise of stainless steel.

It should also be appreciated that one of the unique features believed characteristic of the present application is that it allows a user to finely adjust the length of system 101.

Figure 2A:
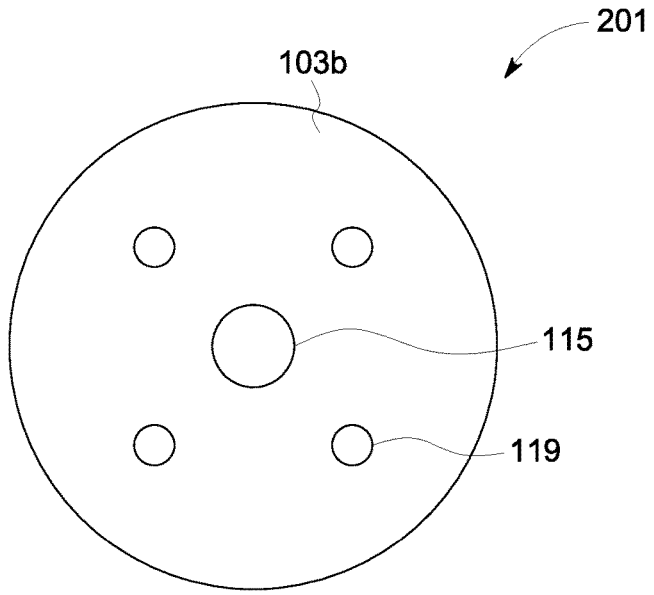
FIG. 2A is a front view of a preferred embodiment of the screw jack system of the present application, illustrating the second end plate without a rubber grip attached.
Figure 2B:
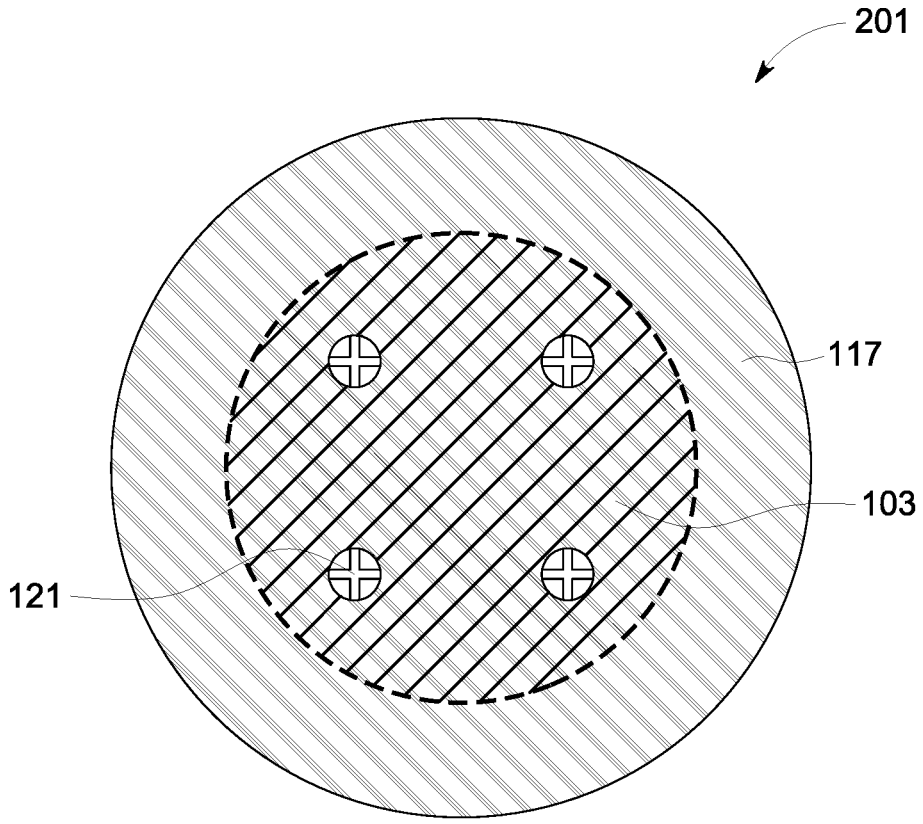
FIG. 2B is a front view of a preferred embodiment of the plate of the screw jack system of the present application, illustrating an end plate with a rubber grip attached.

FIGS. 2A and 2B depict front views of a preferred embodiment of the screw jack system of the present application. Specifically, FIG. 2A illustrates the front view 201 of the second end plate 103*b* without a rubber pad 117 secured therein. FIG. 2B shows the front view 201 of the second plate 103*b* with a rubber pad 117 secured therein via the plurality of screws 121.

The particular embodiments disclosed above are illustrative only, as the embodiments may be modified and practiced in different but equivalent manners apparent to those skilled in the art having the benefit of the teachings herein. It is therefore evident that the particular embodiments disclosed above may be altered or modified, and all such variations are considered within the scope and spirit of the application. Accordingly, the protection sought herein is as set forth in the description. Although the present embodiments are shown above, they are not limited to just these embodiments, but are amenable to various changes and modifications without departing from the spirit thereof.

What is claimed is:

1. A screw jack system, consisting of:

a first end plate;

a second end plate;

a first rubber grip attached to the first end plate, the first rubber grip having a width;

a second rubber grip attached to the second end plate;

a bolt;

a first nut;

second nut; and a plurality of screws having a first length;

wherein the first end plate incorporates a plurality of openings to receive a first group of screws of said plurality of screws, the plurality of openings having a second length;

wherein the first length of the first group of said plurality of screws extends partially within the second length and through the entire width of the first rubber grip;

wherein the second end plate incorporates a plurality of openings to receive a second group of screws of said plurality of screws;

wherein the first and second group of screws of said plurality of screws secure the first rubber grip to the first end plate and the second rubber grip to the second end plate, respectively:

wherein the bolt incorporates a thread;

wherein the second nut incorporates an elongated barrel;

wherein the elongated barrel comprises an internal thread that is configured to receive the thread of the bolt;

wherein the first nut is directly coupled to the first end plate;

wherein the first nut is configured to allow fine length adjustments; and wherein the second nut is directly coupled to the second end plate.

2. The system of claim 1, wherein the first end plate comprises of stainless steel.

3. The system of claim 1, wherein the second end plate comprises of stainless steel.

* * * * *